US005951072A

United States Patent [19]

McElary

[11] Patent Number: 5,951,072

[45] Date of Patent: Sep. 14, 1999

[54] BEDROOM DOOR BRACE SECURITY SYSTEM

[76] Inventor: Laurie Fenton McElary, R.R. #2, Frankford, Ontario, Canada, K0K 2C0

[21] Appl. No.: 08/524,876

[22] Filed: Sep. 7, 1995

[30] Foreign Application Priority Data

May 17, 1995 [CA] Canada ..... 2149582

[51] Int. Cl.[6] ..... E05C 17/54

[52] U.S. Cl. ..... 292/339; 292/DIG. 15

[58] Field of Search ..... 292/339, 338, 292/DIG. 15

[56] References Cited

U.S. PATENT DOCUMENTS 1,332,473 3/1920 Shirley ..... 292/339

4,019,765 4/1977 Nichola ..... 292/338

4,883,297 11/1989 Smith ..... 292/339

5,286,075 2/1994 Monzingo ..... 292/339

*Primary Examiner*—Rodney M. Lindsey

[57] ABSTRACT

A door security system is described for securing an interior door against forced entry. A panel is placed in overlying relation to the door and slidably engaged with a lower end thereof. The panel includes upper brace support members. Telescopically extending jamb engaging members are provided at the floor and lower brace support members are provided in spaced relation thereto. Rigid braces are provided between the upper and lower brace supports so as to secure the door without reliance on either the door hardware or frictional engagement with the floor.

5 Claims, 2 Drawing Sheets

BEDROOM DOOR BRACE SECURITY SYSTEM

BACKGROUND OF THE INVENTION

1. Field of the Invention

This invention relates to a means for securing inward opening bedroom or other interior doors. It consists of two braces, one for each side of the door. They go from the floor a suitable distance inside the room to part way up the door providing resistance to forced entry. The two lower and the two upper brace supports are designed so as not to require any nails, screws, bolts, brackets or holes etc. in the original house construction. The method used for securing the two upper brace supports also provides a panel for extra strengthening backup to a portion of the door itself. This is a set up and take down after use device.

2. Description of the Prior Art

The U.S. patent entitled DOOR SECURITY DEVICE, U.S. Pat. No. 5,286,075, discloses an improved door security device for a door having a doorknob and consists of an elongated leg brace. A base is located on a lower end of the leg brace for frictional engagement upon a floor. A structure is located on an upper end of the leg brace for engaging the doorknob on the door so as to prevent an unauthorized opening of the door. This system, however, gives resistance support to only one side of the door, does not provide any backup support to the door itself and the security aspect relies on friction that could vary in effectiveness with each different floor surface.

SUMMARY OF THE INVENTION

An object of this invention is to provide an improved temporary device for securing inward opening bedroom or other interior doors.

BRIEF STATEMENT OF INVENTION

By one aspect of this invention there is provided a security system for a door mounted in a door jamb, comprising: a pair of rigid brace members each having first and second longitudinal ends; a pair of laterally extendable jamb engaging members each rigidly secured to a respective end of a laterally extending telescoping member; means to lock said telescoping member in an extended position in which said jamb engaging members are engaged with said door jamb; a door panel member for placement in overlying planar relationship adjacent a lower end of said door, said panel member including angle bracket means rigidly secured to a first end thereof for sliding lockable relation with said lower end of said door; a first pair of laterally spaced brace support means secured adjacent an opposed second end of said panel member, to receive and releasably secure said first end of a respective one of said rigid brace members; a second pair of laterally spaced brace support means secured in spaced relation to said telescoping member, to receive and releasably secure said second end of a respective one of said rigid brace members.

DETAILED DESCRIPTION OF PREFERRED EMBODIMENTS

Figure 1:
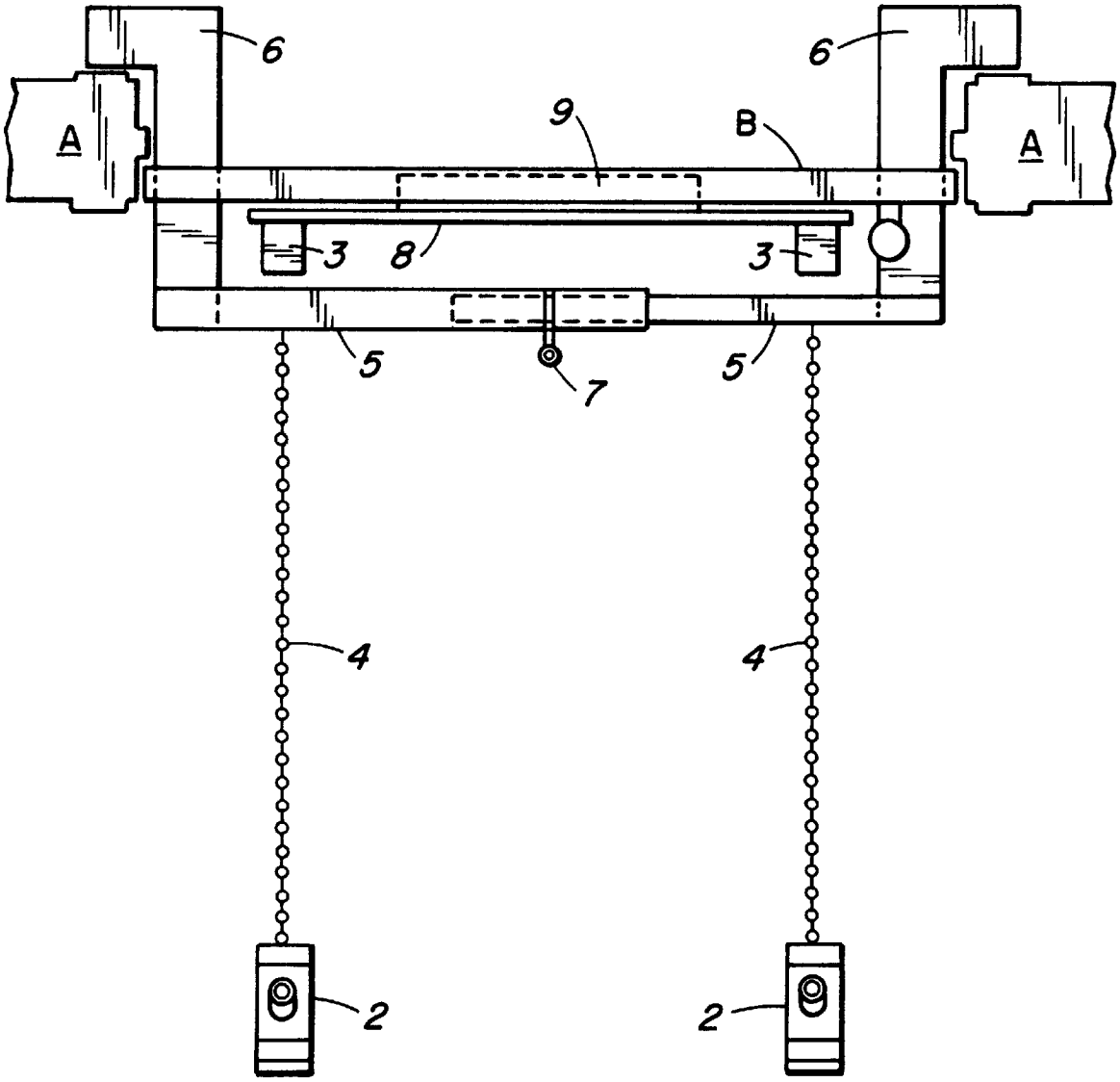
FIG. 1 is a top plan view of one embodiment of the invention.

As seen in FIG. 1 there are provided a pair of spaced apart lower brace supports 2, generally formed in metal and each including a short length of pipe to receive and retain one end of a rigid brace member 1. Supports 2 are laterally spaced from each other and from a door B, and are each secured by a chain 4 to a telescoping tube member 5, each end of which is rigidly mounted on a respective shaped anchor plate 6, generally fabricated from a hardened and tempered metal about 3/16 inches thick. Anchor plates 6 are shaped to slidably engage with a respective door jamb A. When engaged with the door jamb A, a pin 7 is inserted through aligned holes in the telescoping parts of tube member 5, so as to releasably secure the tube members in an extended locked position.

Figure 2:
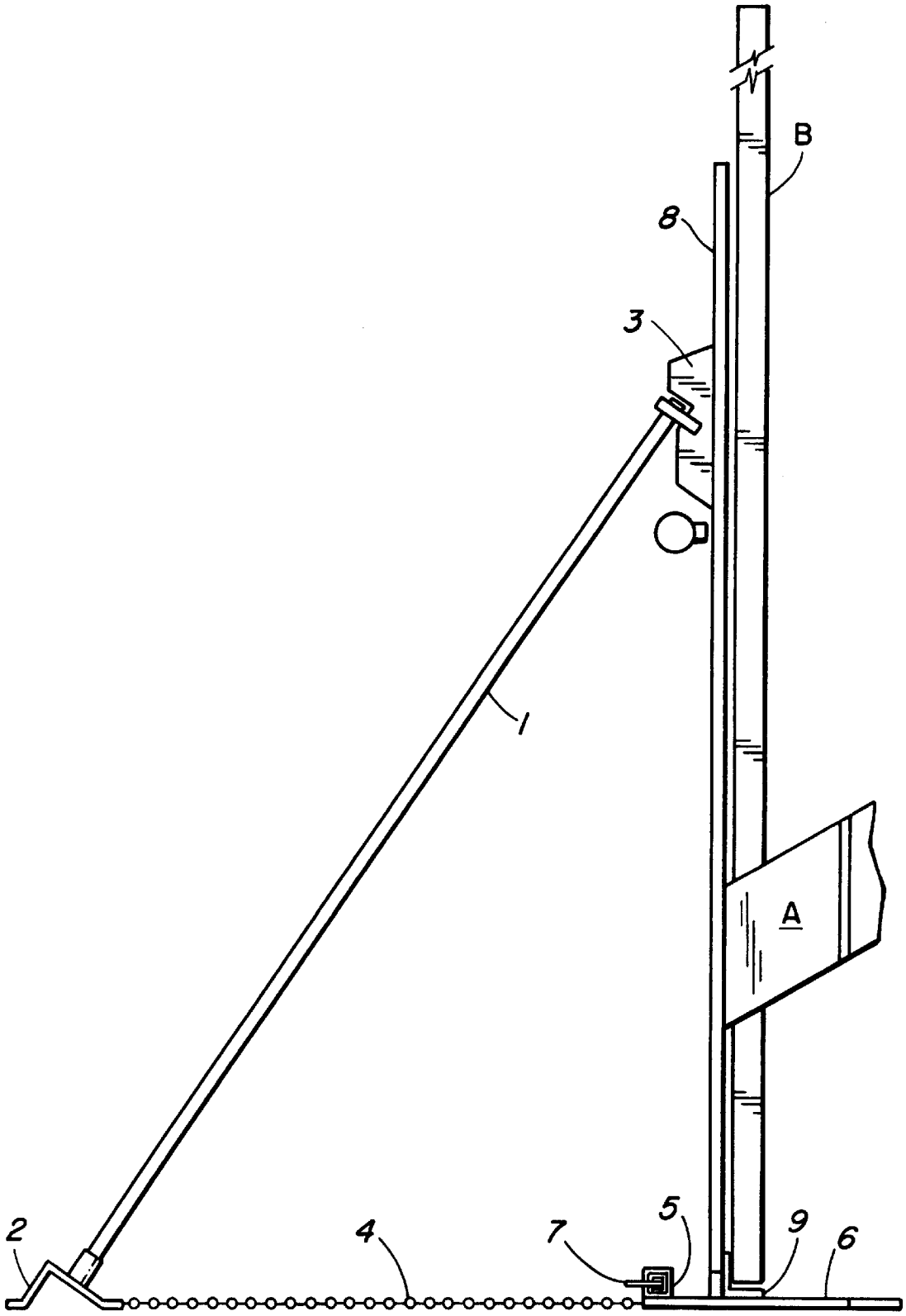
FIG. 2 is a side view of the embodiment of FIG. 1.

As seen more clearly in FIG. 2, there is also provided a substantially rectangular door backing panel 8, preferably made of plywood, approximately two thirds of the height of the door B from the ground. Panel 8 is provided with an L-shaped angle member 9, preferably fabricated in metal, which extends along a central portion of the lower floor engaging end of panel 8. Angle member 9 extends under the lower end of door B and slidably engages therewith so as to prevent upward movement of panel 8 in the event of applied pressure on the door.

Panel 8 is also provided, adjacent the upper edge thereof, with a pair of laterally spaced apart upper brace supports 3, each fabricated from wood, metal or plastic and adapted to receive and releasably retain a respective upper end of a brace member 1. Supports 3 may, optionally, be provided with spring clips (not shown) to secure the brace member thereto.

I claim:

1. A security system for a door mounted in a door jamb, comprising:

a pair of rigid brace members each having first and second longitudinal ends;

a pair of laterally extendable jamb engaging members each rigidly secured to a respective end of a laterally extending telescoping member;

means to lock said telescoping member in an extended position in which said jamb engaging members are engaged with said door jamb;

a door panel member for placement in overlying planar relationship adjacent a lower end of said door, said panel member including angle bracket means rigidly secured to a first end thereof for sliding lockable relation with said lower end of said door;

a first pair of laterally spaced brace support means secured adjacent an opposed second end of said panel member, to receive and releasably secure said first end of a respective one of said rigid brace members; and a second pair of laterally spaced brace support means secured in spaced relation to said telescoping member, to receive and releasably secure said second end of a respective one of said rigid brace members.

2. A security system as claimed in claim 1, including a pair of flexible members to secure respective ones of said second pair of brace support means to said telescoping member.

3. A security system as claimed in claim 2, wherein said flexible members comprise chains.

4. A security system as claimed in claim 1, wherein said brace members comprise tubular metal members.

5. A security system as claimed in claim 4, wherein said second pair of brace support means include tubular means to receive and releasably retain a respective one of said tubular metal members.

* * * * *